United States Patent [19]

Kovac et al.

[11] Patent Number: 4,995,600

[45] Date of Patent: Feb. 26, 1991

[54] GENERAL-PURPOSE FOLDING MACHINE

[75] Inventors: Josip Kovac, Ozoir-la-Ferriere; André Ferreol-Ragotin, Evry, both of France

[73] Assignee: Societe Anonyme dite: Alcatel Satman, Bagneux, France

[21] Appl. No.: 302,650

[22] Filed: Jan. 27, 1989

[30] Foreign Application Priority Data

Jan. 29, 1988 [FR] France ..... 88 01063

[51] Int. Cl.[5] ..... B42C 1/00

[52] U.S. Cl. ..... 270/45; 493/444; 493/445

[58] Field of Search ..... 270/32, 39, 45; 493/444, 445, 451, 435, 460, 461

[56] References Cited

U.S. PATENT DOCUMENTS

| | | | |
|---|---|---|---|
| 2,514,737 | 7/1950 | Anderson . | |
| 4,059,258 | 11/1977 | Grantham | 493/444 |
| 4,179,111 | 12/1979 | Gunther et al. . | |
| 4,439,175 | 3/1984 | Cimochowski | 493/451 |
| 4,569,672 | 2/1986 | Marion | 493/444 |
| 4,678,173 | 7/1987 | Basinger | 270/45 |
| 4,781,367 | 11/1988 | Stab | 270/45 |

FOREIGN PATENT DOCUMENTS

| | | | |
|---|---|---|---|
| 2630170 | 1/1977 | Fed. Rep. of Germany . | |
| 4424354 | 11/1979 | France . | |
| 7414903 | 5/1976 | Netherlands | 493/451 |

*Primary Examiner*—Edward K. Look
*Assistant Examiner*—Therese M. Newholm
*Attorney, Agent, or Firm*—Sughrue, Mion, Zinn, Macpeak & Seas

[57] ABSTRACT

A general-purpose document folding machine comprises a folding module including at least one folding blade on a main document path. A pair of feed rollers and a pair of ejector rollers for advancing and ejecting documents are associated with each folding blade, disposed one on each side thereof and adapted to have the rollers driven to advance documents along the main path. At least one deflector flap on the main path diverts selectively from the main path documents that are to be folded. Drive means displace each folding blade transversely to a diverted document facing it in order to fold the document and also displace each folding blade along the main path at a longitudinal speed substantially equal to the rate of advance of the documents along the main path. This is in order to fold a diverted document while in motion and insert it between the rollers of the respective pair of ejector rollers. A guide flap associated with each folding blade is disposed transversely to the main path between the folding blade and the associated pair of ejector rollers and is linked to the main path by the deflector flap when the latter is in its diversion position to define a secondary document path between the folding blade and the associated pair of ejector rollers.

23 Claims, 9 Drawing Sheets

GENERAL-PURPOSE FOLDING MACHINE

BACKGROUND OF THE INVENTION

1. Field of the invention

The present invention relates to machines for folding documents comprising single or multiple sheets. It applies in particular to a machine for folding automatically mail to be placed in envelopes.

2. Description of the prior art

Document folding machines are already widely used in the automatic handling of mail and newspapers. In the case of automatic mail handling they are usually of the so-called "pocket" type. In the case of automatic processing of newspapers they are generally of the so-called "knife" type.

Known pocket type folding machines comprise for the first fold three rollers and an associated trough (the "pocket") which is fitted with an adjustable stop member. First and second rollers receive between them each sheet to be folded which they insert into the pocket as far as the stop member. When the sheet is stopped by the stop member it forms a loop as the rollers continue to feed it. The loop is gripped between the second and third rollers to achieve the required folding. For a second fold these folding machines comprise two further rollers associated with the third of the previously mentioned rollers and an additional trough or pocket with a stop member.

The second fold is made by the third roller, the two additional rollers and the pocket associated with the latter, in the same way as the first fold.

The stop member in each pocket is adjusted to the required fold length. It is possible to obtain a single fold from a machine with multiple pockets by shutting off access to all but one pocket or by replacing each unnecessary pocket with a guide deflector.

Generally speaking, such pocket type folding machines operate in a very satisfactory way. However, their main disadvantage is that they can only accept multiple documents for folding simultaneously if they have the same format and a limited overall thickness, in other words if they comprise only a small number of identical single sheets. Also, adapting these folding machines to the number of folds required and to different fold lengths, which adjustments are made to the pockets, is an operation which although simple is relatively time-consuming.

Knife type folding machines essentially comprise a blade mounted to one side of and in line with a path along which documents to be folded are fed and on which each document is stopped, together with a pair of ejector rollers associated with the blade and mounted on the opposite side of this path. The blade is actuated transversely to the document to be folded when the document is stopped so that the document is then taken up by the pair of ejector rollers associated with the blade. A second fold can be achieved in a similar way on a second feed path coupled to the pair of rollers which eject documents from the first path. A second blade is mounted in line with this second path and is associated with a second pair of ejector rollers.

Such knife-type folding machines also function in a satisfactory way. They are generally employed to fold multiple documents having some significant thickness, such as newspapers for example. On the other hand, because the documents are stopped for each folding operation, the throughput remains low. These machines are also bulky. They also render each folding operation mandatory as otherwise the documents cannot be ejected.

The document FR-A-No. 2.424.354 discloses a machine for folding cloth articles such as tablecloths or sheets. The machine comprises pairs of belts, one long and the other short, for advancing and ejecting the articles, pivoting folding blades and deflector flaps associated with the blades. Each deflector flap diverts the article to be folded as it is advanced; the associated folding blade is pivoted to fold the diverted article. In this machine the feed direction of one of the belts is reversed to advance and divert the article and to eject it.

This machine is bulky. Also, its control system is complex because of this reversing of the feed direction of one of the belts during each folding operation.

An object of the present invention is to provide a new folding machine avoiding the disadvantages of the aforementioned known folding machines whilst incorporating their advantages. Specifically, the folding machine in accordance with the invention, which processes documents, can accept multiple documents to be folded simultaneously with different formats and with a greater or smaller overall thickness and can function with long fold lengths and at high speeds which are easy and quick to adjust; furthermore, it has small overall dimensions whereby it is extremely compact.

SUMMARY OF THE INVENTION

The invention consists in a general-purpose document folding machine comprising a folding module and in said folding module means defining a substantially linear main document path, a folding blade or a plurality of folding blades on said main path and, associated with said folding blade or each folding blade of said plurality of folding blades, means on said main path for advancing and ejecting documents in the form of a pair of feed rollers and a pair of ejector rollers associated with said folding blade, disposed one on each side thereof and adapted to have said rollers driven to advance documents along said main path, a deflector flap adapted to divert selectively from said main path documents that are to be folded, drive means adapted to displace said folding blade transversely to a diverted document facing it in order to fold said diverted document and to displace said folding blade along said main path at a longitudinal speed substantially equal to the rate of advance of said documents along said main path in order to fold a diverted document while in motion and insert it between the rollers of said pair of ejector rollers, and a guide flap associated with said folding blade disposed transversely to said main path between said folding blade and said associated pair of ejector rollers and adapted to be linked to said main path by said deflector flap when the latter is in a diversion position to define a secondary document path between said folding blade and said associated pair of ejector rollers.

The characteristics and advantages of the present invention will emerge more clearly from the following description of one preferred embodiment shown in the appended drawings.

DESCRIPTION OF THE PREFERRED EMBODIMENT

In the embodiment shown the general-purpose folding machine in accordance with the invention can fold documents that it receives either once or twice in succession. It can also do no folding at all. It is of the so-called knife type wherein each fold is formed by operating the "blade" of the "knife".

Figure 1:
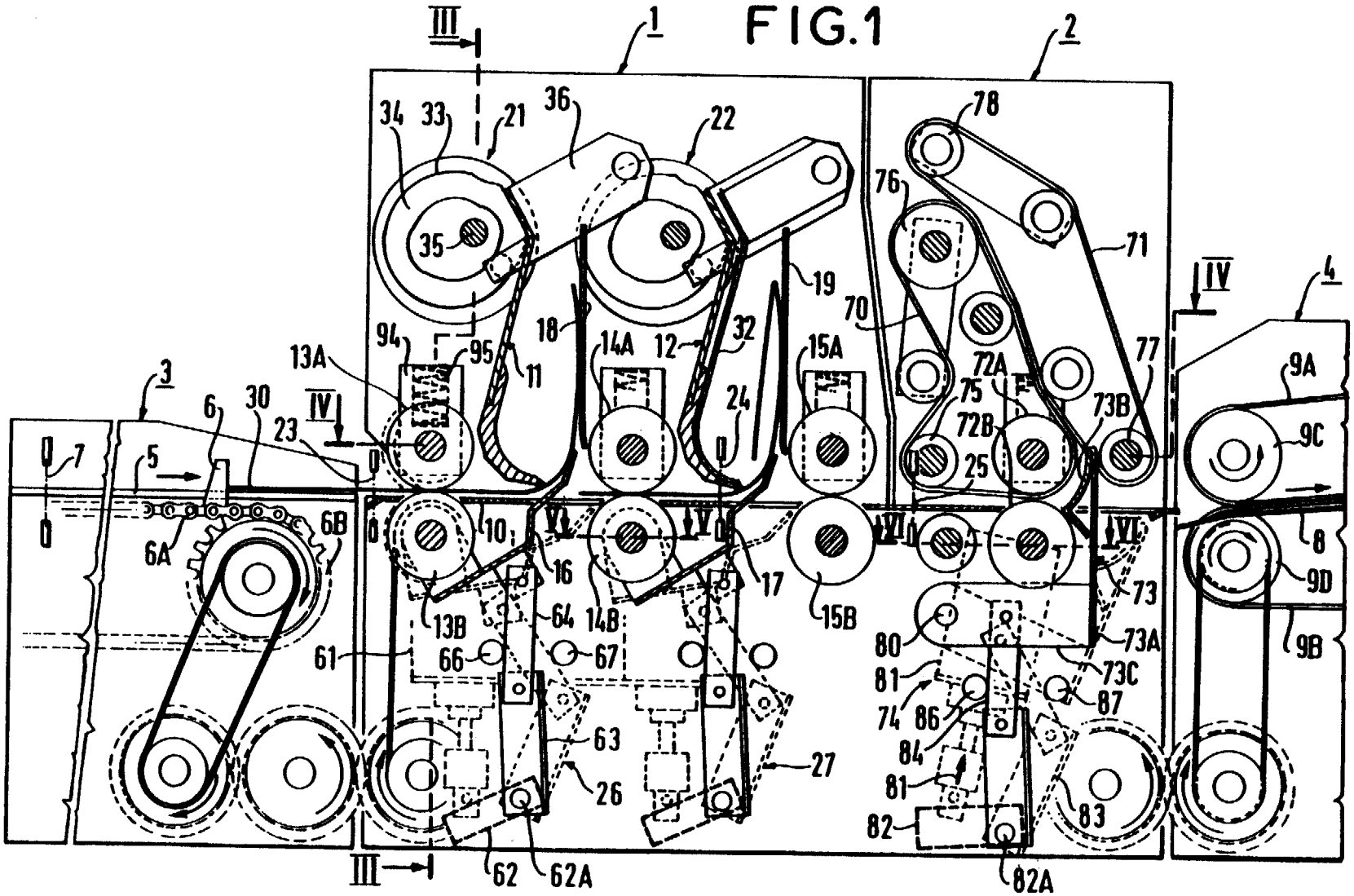
FIG. 1 is a view in cross-section of a general-purpose folding machine in accordance with the invention.

Referring to FIG. 1, it is seen that the general-purpose folding machine comprises a folding module 1 with which is associated a module 2 for turning over the folded documents. The folding module 1 and the overturning module 2 are coupled to an input module 3 which feeds them with documents to be folded and to an output module 4 supplying the folded and optionally turned over documents.

The input module 3 is known in itself. It comprises a horizontal platform 5 over which the documents are advanced by projecting lugs 6 carried by an endless chain 6A driving them in a closed loop around a sprocket wheel 6B just upstream of the module 1. The lugs return to the entry to the platform 5 in a retracted condition. The documents reach the entry to the platform 5 from an unstacking and/or assembly device.

The chain is driven intermittently to transfer the successive received documents to be folded which are taken up and pushed as far as the folding module by the lugs projecting above the platform 5. These arrangements are known in themselves and will not be described in more detail.

In the input module 3, a photosensor 7 detects the passage of each document taken up by one of the lugs and transferred towards the folding module 1.

The output module 4, only part of which has been sketched in, is also known in itself. It couples the folding module 1 and the overturning module 2 to a machine for inserting the documents into envelopes, of which machine it normally forms part. It defines the input path of the folded documents into the inserting machine. It comprises a platform 8 over which passes at least one pair of endless belts 9A, 9B running on respective pulley wheels 9C, 9D; the folded documents to be placed in envelopes are fed along the platform 8 between the belts.

Figure 2:
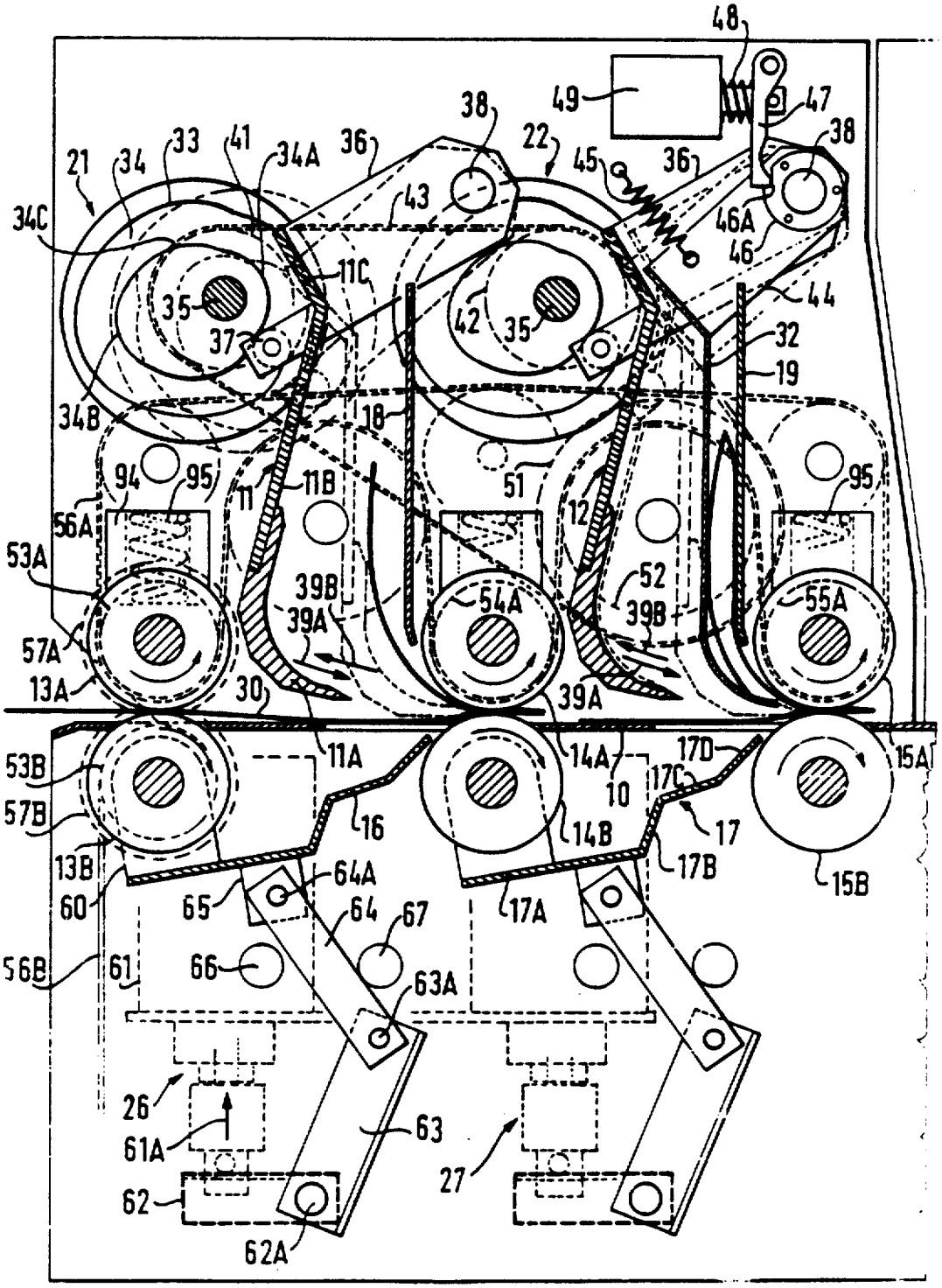
FIG. 2 is a view in cross-section to an enlarged scale of a folding module from the general-purpose folding machine in FIG. 1.

The folding module 1 to which the present invention essentially relates is described initially with reference to FIG. 1 and also with reference to FIG. 2. It comprises a substantially horizontal main document path 10. This main path is aligned with those defined by the platforms 5 and 8 of the input module 3 and the output module 4, respectively, which it couples together. It comprises a platform also designated by the reference number 10 in which are openings and along which are mounted pairs of drive rollers described in more detail hereinafter.

The folding module 1 comprises along the main path 10:

first and second folding blades 11 and 12 disposed one after the other, above the main path 10 and across its full width, two pairs of rollers 13A, 13B and 14A, 14B along the main path 10 of which one is on the upstream side of the first folding blade 11 and the other is on its downstream side, associated with the first folding blade and defining a pair of feed rollers and a pair of ejector rollers for the first folding blade, two pairs of rollers along the main path and associated with the second folding blade 12, the upstream pair of rollers 14A, 14B actually consisting of the pair of ejector rollers for the first folding blade and defining a pair of feed rollers for the second folding blade 12 and the downstream pair 15A, 15B defining a pair of ejector rollers for the second folding blade, a first deflector flap associated with the first folding blade 11 and a second deflector flap 17 associated with the second folding blade 12 disposed underneath the main path 10 and each extending along it downstream of its associated folding blade but not as far as the pair of ejector rollers for that folding blade, and a first guide flap 18 associated with the first folding blade 11 and a second guide flap 19 associated with the second folding blade 12 each disposed substantially vertically above the main path 10 and just upstream of the pair of ejector rollers for the corresponding folding blade.

Figure 3:
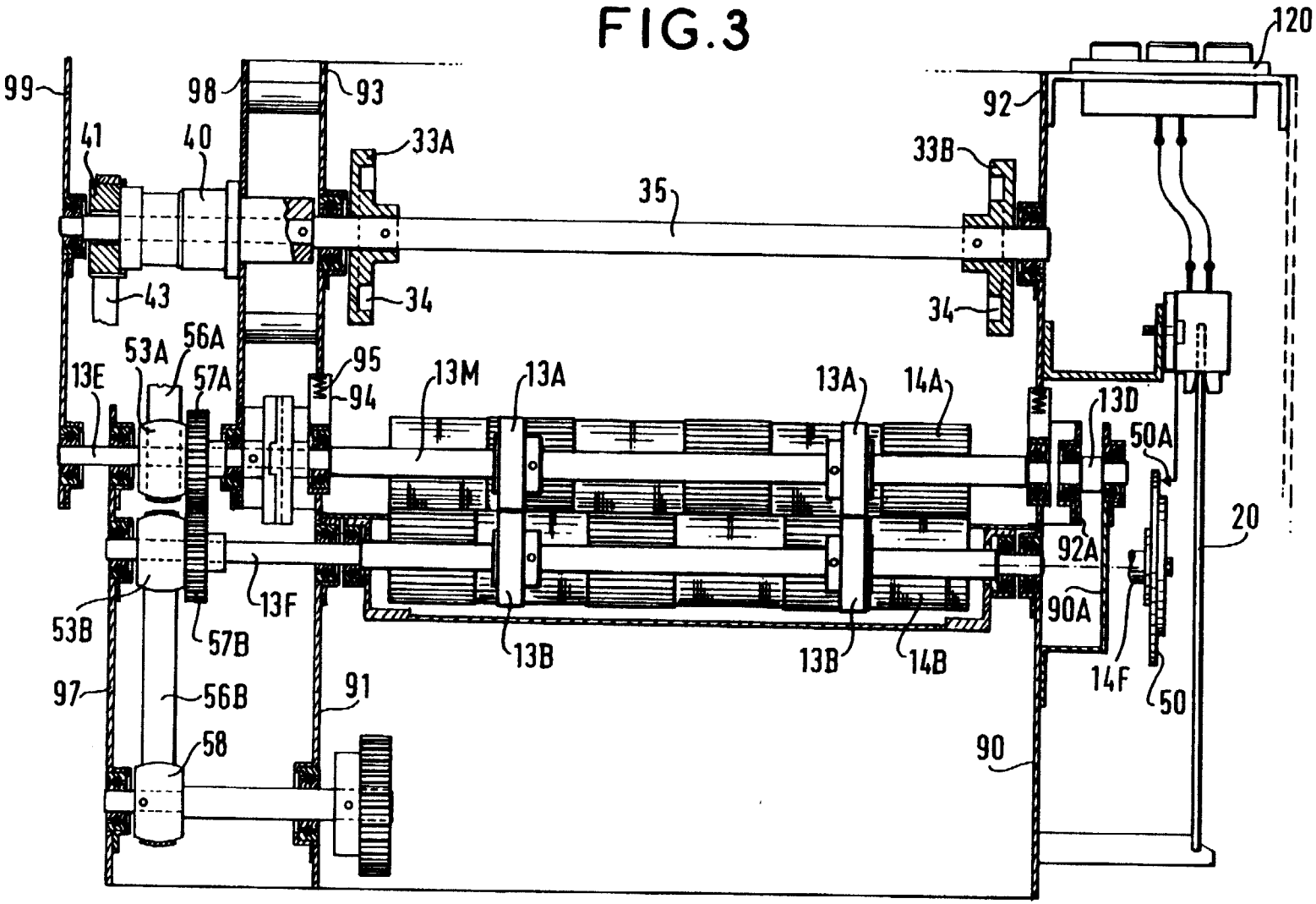
FIG. 3 is a simplified view of the folding machine in transverse cross-section on the line III—III in FIG. 1 showing in particular part of its control mechanism and its feed system.

A control circuit for the folding machine is carried by a control board 20 attached to the side flanges of the folding module (FIG. 3). It supplies signals controlling the folding blades 11 and 12 and the deflector flaps 15 and 17. Respective individual control mechanisms 21 and 22 (for the folding blades 11 and 12) and 26 and 27 (for the deflector flaps 16 and 17) control the respective devices in accordance with the control signals that they receive. These individual control mechanisms are described later. To fold a document 30 by means of one or both of the folding blades 11 and 12 when the document reaches them the deflector flap associated with the folding blade in question is actuated so as to intersect the main path 10 and divert the document passing under the folding blade in question against the guide flap also associated with this blade. This folding blade is then actuated transversely to the document diverted from the main path according to a specific operating mode imparting to it a so-called longitudinal speed parallel to the main path 10 substantially equal to that at which the document moves along the main path 10.

Photosensors detect the passage of documents along the main path 10, in particular at the entry to the folding module 1, at an intermediate point and at the exit. These photosensors are designated 23 for that at the entry, 24 for that at an intermediate point and 25 for that at the exit. Like the photosensor 7 of the module 3, each comprises an emitter cell and a detector cell sited remotely of the sensing point concerned to which they are coupled by optical fibers. These sensing points along the path 10 are at known distances from the sensing point defined by the photosensor 7 which is itself at known distances from the various component parts of the folding machine along the main path 10, and these various known distances enable operation of the folding machine to be controlled.

In FIG. 1 both folding blades 11 and 12 are shown in their unoperated position and the deflector flaps 16 and 17 are shown in dashed outline in their unoperated position (in which they are outside the main path 10) and in full outline in their diversion position (in which they intersect the main path). In FIG. 2 the deflector flaps 16 and 17 are shown only in their unoperated position and the folding blades 11 and 12 are shown in full outline in their unoperated position and in dashed outline in the folding position. With regard to the blade 12 in its unoperated position, note that FIG. 2 corresponds to an operating phase of the folding machine which directly succeeds that shown in FIG. 1.

In the folding module 1 the rollers of each successive pair of rollers are on either side of the main path 10 and press against each other through the platform defining the main path. These pairs of rollers feed each document to be folded or not as required and eject them. The pair of feed rollers for each folding blade defines on the main path a document feed path for that blade. The guide flap associated with each folding blade defines a secondary path for the folding blade in question onto which the document to be folded by that blade is diverted. The secondary path is connected to the main path 10, or to be more precise to the document feed path for the folding blade concerned, by the deflector flap associated with this folding blade, when the latter intersects the main path. The feed path and the secondary path for each of the folding blades 11 and 12 are where necessary designated hereinafter by the reference numbers of the pair of feed rollers and of the guide flap which respectively define them.

With reference to FIG. 1 and with more particular reference to FIG. 2 in which the folding module in shown in a different phase of operation, it is seen that the first folding blade 11 is a single blade whereas the second folding blade 12 is as it were a double blade comprising a blade carrying the reference number 12 which is identical to the folding blade 11 and a "counter-blade" 32 the profile of which mates with that of the blade 12 so that it can lie against the latter.

The shape of the folding blade 11 in cross-section is generally similar to that of a golf club. The blade comprises at its lower end a curved shorter leg 11A mounted on a shank 11B. The end part of the shorter leg 11A is at a small distance from and slightly inclined relative to the main path 10. It extends towards the pair of ejector rollers 14A, 14B. The shank 11B is straight and is slightly inclined to the vertical, starting from the curve in the shorter leg. At the opposite end to the shorter leg 11A the folding blade has an upper part end 11C bent relative to the shank 11B and extending in the opposite direction to the end part of the shorter leg 11A. The concave side of the shorter lower leg of the folding blade 11 faces towards the pair of ejector rollers 14A, 14B associated with that blade.

The folding blade 12 is identical to the folding blade 11. The counter-blade 32 has a similar profile with a curved lower end part slightly shorter than that of the folding blade 12 and a bent upper end part extending in the opposite direction to the lower end part. These parts have not been identified by separate reference numbers.

The control mechanism 21 of the folding blade 11 comprises a cam 33 with a guide path 34 mounted on a control shaft 35. The cam 33 controls a pivoting lever 36 coupled to the folding blade 11.

The control mechanism 21 is described in more detail with reference to FIGS. 2 and 3.

FIG. 3 shows that the aforementioned control cam is a double cam. It is formed by two disks 33A and 33B mounted eccentrically on the control shaft 35. The disks are identical and the guide paths 34 are on their sides facing towards each other.

Referring to FIG. 2 it is seen that the guide path 34 is a groove in a closed loop eccentric to the control shaft 35. This groove defines two opposed substantially circular parts joined to each other on each side and designated by the reference numbers 34A and 34B carried by the interior contour of the groove. The part 34A is centered on the control shaft; it corresponds substantially to a circular sector subtending an angle of 120° and is the part for holding the folding blade 11 in the unoperated position. The part 34B has its center offset from the control shaft on the side opposite the part 34A. The part 34B corresponds to a circular sector subtending an angle of approximately 20°. It defines the position of maximum advance of the folding blade 11.

The parts 34A and 34B are joined by transitional parts 34C which constitute the "working" parts of the cam in that they move the blade to the folding position and return it to the unoperated position, both movements being performed at constant speed.

The grooves in the two disks 33A and 33B are identical; each guides an end roller 37 carried by the control lever 36. The lever 36 is a double lever comprising two branches fastened to the upper end part 11C of the folding blade and extending transversely to either side of the upper end part 11C at both ends thereof. These two branches of the lever are identical to the single branch seen in FIG. 2 and carrying the reference number 36 of the control lever. The end roller 37 carried by each branch is an idler roller trapped in the groove of the corresponding disk. At the end opposite the roller each branch pivots about a fixed shaft 38.

The cam is rotated in one direction only by its control shaft 35 when the latter is driven. The part 34A of the groove 34 holds the folding blade 11 in the unoperated position. The parts 34C and 34B of the groove 34 cause the lever 36 to pivot and so actuate the folding blade 11 as shown by the oppositely directed arrows 39A and 39B. When actuated in the direction of the arrow 39A the folding blade 11 moves from the unoperated position to the folding position and when actuated in the direction of the arrow 39B it moves from its folding position to the unoperated position.

The control mechanism 22 of the folding blade 12 proper is identical to the control mechanism 21 of the folding blade 11. The control mechanism 22 is therefore not described here and its component parts have not been identified by reference numbers except for the control lever (which is identical to the control lever 36 for the folding blade 11) and the shaft on which it pivots, which are respectively designated by the same reference numbers 36 and 38. The actuation of the folding blade 12 is also shown by oppositely directed arrows carrying the same reference numbers 39A and 39B as those showing actuation of the folding blade 11.

The control shaft 35 of the mechanism 21 is operated through an individual clutch 40 coupling it to an individual drive pulley 41 (FIG. 3). The control shaft 35 of the mechanism 22 for the blade 12 is operated in exactly the same way through another clutch. This other clutch (not shown) couples the shaft 35 of the mechanism 22 to a drive pulley 42 (FIG. 2). The pulleys 41 and 42 from which the folding blades 11 and 12 are driven are coupled together by a notched endless transmission belt 43. With this notched belt they form part of the overall drive system for the various components of the folding machine.

Each of the individual clutches (e.g. the clutch 40) is controlled by the control circuit carried by the control board 20 (FIG. 3). Each command issued by this circuit causes the control shaft 35 concerned to rotate once only on itself.

For controlling the counter-blade 32 associated with the folding blade 12 a support lug 44 extends transversely over the upper end part of the counter-blade 32 at each end thereof and pivots about the shaft 38 of the control lever 36 of the folding blade 12. The support lug 44 is spring-loaded by a spring 45 to press the counter-blade 42 against the folding blade 12, in particular when the latter is in its unoperated position, and in the absence of any command to the contrary.

The counter-blade 32 is actuated by the folding blade 12: it is pushed by the folding blade 12 when the latter moves from the unoperated position to the folding position; the return of the counter-blade 32 to the unoperated position is delayed relative to the return of the folding blade 12, however.

The support lug 44 is coupled to a mechanism for preventing the counter-blade 32 returning to its unoperated position at the same time as the folding blade 12. As shown in FIG. 2, this non-return mechanism comprises a ratchet wheel 46 fastened to the support lug 44 and centered on the shaft 38, and which has a peripheral notch 46A, and a pawl 47 associated with the wheel. A spring 48 urges the pawl 47 against the periphery of the wheel 46. The pawl 47 allows the ratchet wheel 46 to rotate freely in the anticlockwise direction as the counter-blade 32 moves with the folding blade 12 from the unoperated position to the folding position. It is inserted into the notch 46A when the counter-blade 32 arrives with the folding blade 12 at the folding position. However, it prevents rotation of the ratchet wheel 46 in the clockwise direction and therefore opposes the action of the spring 45 to prevent the counter-blade 32 returning to the unoperated position at the same time as the folding blade. This delayed return of the counter-blade 32 is apparent from FIG. 2 in which the counter-blade 32 is shown in full outline in the folding position, where it was placed by the folding blade 12 (shown in dashed outline), and remains in this folding position when the folding blade 12 has returned to the unoperated position (shown in full outline); the counter-blade is shown in dashed outline in the unoperated position against the folding blade in its unoperated position when its non-return mechanism has allowed it to return to its own unoperated position.

The return of the counter-blade 32 into the unoperated position against the folding blade 12 already in that position is triggered by a solenoid 49 the plunger of which is coupled to the pawl 47. The solenoid 49 pivots the pawl so that it leaves the notch 46A and enables clockwise rotation of the ratchet wheel 46. The solenoid is controlled by the control circuit carried by the control board 20 (FIG. 3).

This arrangement with a counter-blade associated only with the second folding blade 12 serves to hold correctly the document 30 which may have already been folded a first time by the first folding blade 11, as seen from FIG. 2. There is therefore no need for any such counter-blade for the first blade.

The overall drive system for the various component parts of the folding module 1, including in particular the pulleys 41 and 42 and the notched transmission belt 43 coupling them together, is described with reference to FIG. 2. This system further comprises, mounted on a common transmission shaft not identified by any reference number, a first transmission pulley 51 driving the belt 43 and a second pulley 52 driving the pulley 51. The second pulley 52 is coupled by an endless belt 56A to drive pulleys 53A, 54A and 55A for the rollers 13A, 14A and 15A situated above the main path 10. A pair of meshing gears 57A and 57B mounted on the drive shafts of the pair of rollers 13A and 13B situated to either side of the main path 10 couples these two rollers together. The gear 57B is in turn driven by a pulley 53B on the same shaft as itself and a drive belt 56B. The belt 56B couples the pulley 53B to similar drive pulleys on the shafts of rollers 14B and 15B. Tension pulleys (not shown) are associated with the belts 56A and 56B.

Figure 7:
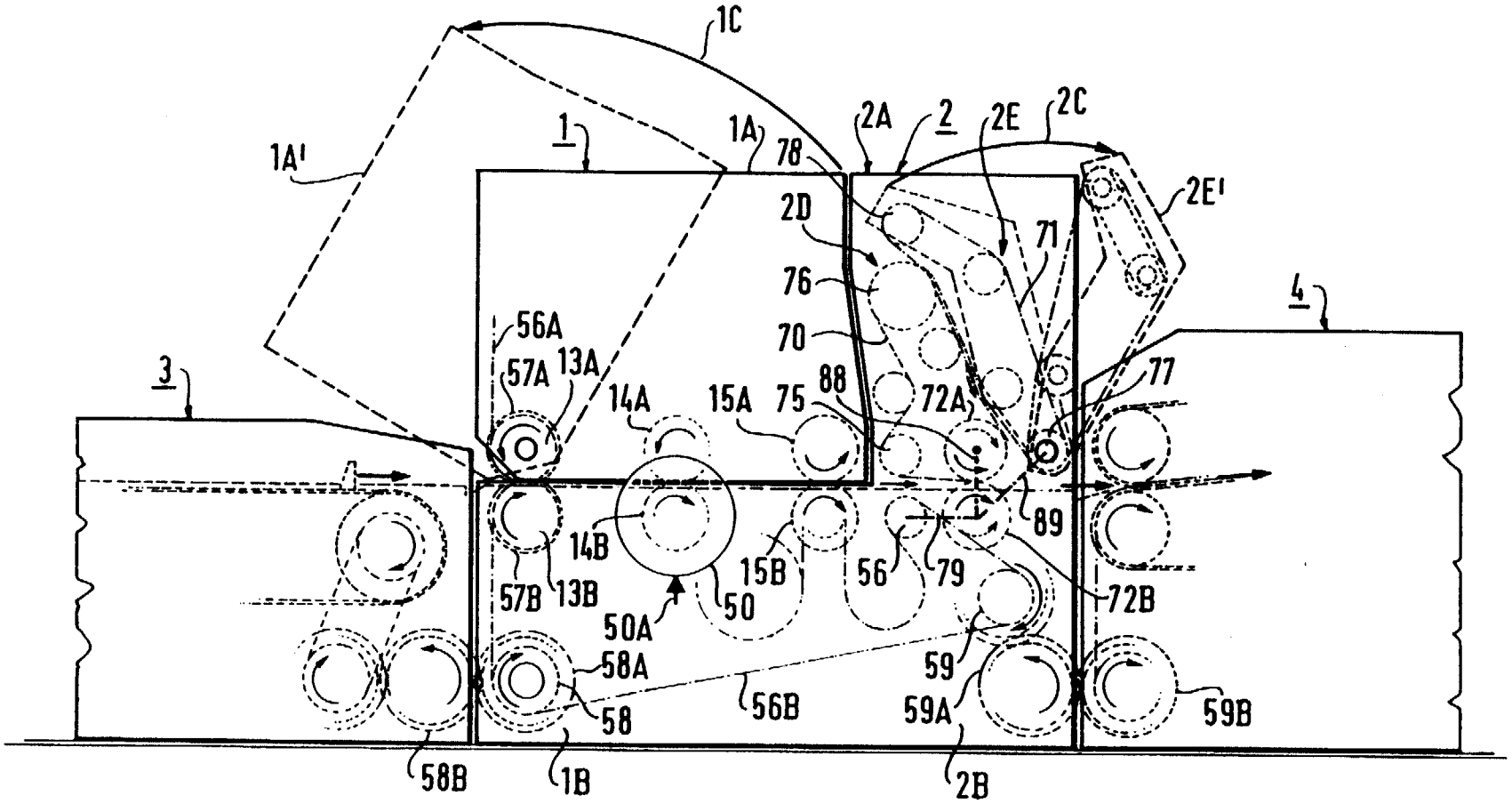
FIG. 7 is a schematic view in elevation of the folding machine from FIG. 1 showing its general organization.

FIG. 7 shows that the belt 56B drives a pulley 58 and is driven by a drive pulley 59; the latter is in turn driven by a motor (not shown) mounted in the lower part of the folding machine or of the equipment as a whole and from which all the component parts of the folding machine are driven, as and when commanded. A pair of gears 58A on the shaft carrying the pulley 58 and 58B meshing with the gear 58A drive the components of the input module 3 from the aforementioned motor. Similarly, a pair of gears 59A, 59B of which one is coupled to the drive pulley 59 receiving the belt 56B and the other meshes with the gear 59A drive the components of the output module 4 and of the machine of which it forms part together with the components of the folding machine. A second, direction-changing pulley 56 receiving the belt 56B also drives the component parts of the overturning module.

The control mechanism 26 for the deflector flap 15 is described with reference to FIG. 1 in which it is respectively shown in full outline and in dashed outline for the unoperated and diversion positions of the deflector flap and with reference to FIG. 2 in which it is shown only for the unoperated position of the deflector flap 16.

The deflector flap 16 is carried by the same shaft as the roller 13B. To this end it comprises two end lugs 60 so that it can rotate relative to this shaft and so pivot on it.

It is caused to pivot by a solenoid 61 and a control lever 62 coupled to the plunger of the solenoid. This control lever pivots on a fixed shaft 62A. It transmits commands that is receives to the deflector flap 16 through a knuckle joint linkage comprising a lever 63 and coupling arm 64. The lever 63 has one end pivoted on the fixed shaft 62A and is fastened by this shaft to the control lever 62 so as to transmit commands applied to the latter.

The other end of the lever 63 is articulated at 63A to one end of the arm 64 the other end of which is articulated at 64A to an intermediate coupling lug 65 on the deflector flap 16. Two abutment members 66 and 67 on either side of the arm 64 limit the movement of the arm 64 to place and respectively hold the deflector flap 16 in the unoperated position and the diversion position. In FIG. 1, because it is offset from the lever 63 on the shaft 62A, the control lever 62 is shown in thick dashed outline in only the position for which the deflector flap is in the diversion position; the lever 63 and the arm 64 are then in the position shown in full outline with the arm against the abutment member 66.

The solenoid 61 is normally energized or unenergized according to whether the unoperated position or the diversion position of the deflector flap is chosen as the normal position, as schematically shown by the arrow 61A. It then drives the levers 62 and 63 and the arm 64 as shown in FIG. 2 or as shown in dashed outline for the lever 63 only and the arm 64 in FIG. 1. The solenoid is controlled by the control circuit of the folding machine carried by the board 20 (FIG. 3).

The control mechanism 27 for the deflector flap 17 is identical to the control mechanism 26 for the deflector flap 16. It is therefore not described hereinafter and its component parts do not carry reference numbers. Its solenoid is also controlled by the control circuit of the folding machine.

Figure 5:
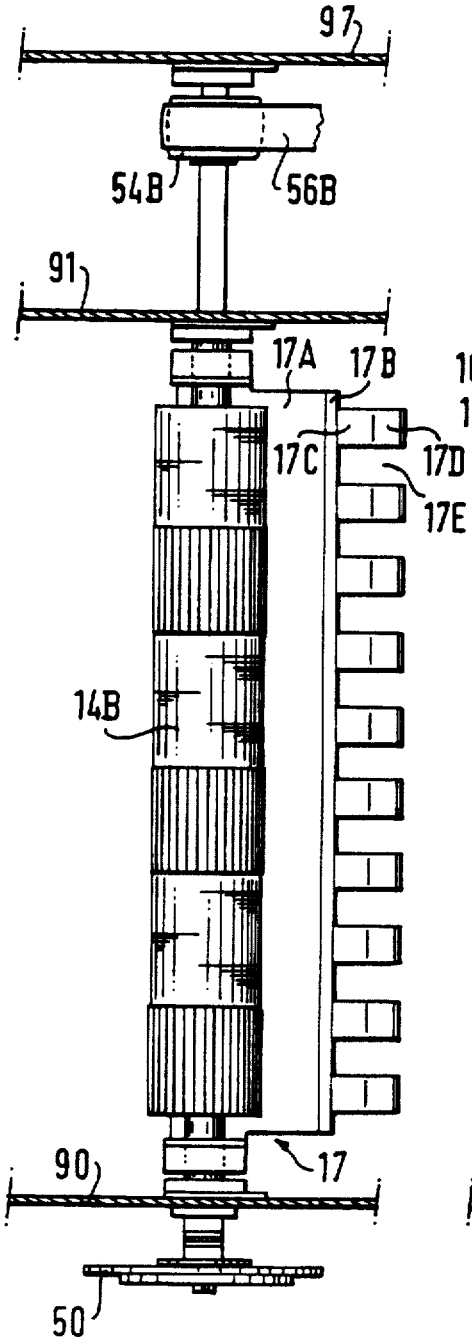
FIG. 5 is a view of the folding machine in longitudinal cross-section on the line V—V in FIG. 1.

With reference to FIGS. 1 and 2, note that the deflector flaps 16 and 17 which are identical and extend across the width of the main path 10 have a profile in which there are several bends. The successive parts defined by these bends are shown in FIG. 2 on the deflector flap 17 in the unoperated position and in FIG. 5 showing the deflector flap 17. The deflector flap 17 has a first part 17A, carrying on opposite sides the attachment lug and the lug coupling it to the flap, which extends along the main path 10 with a slight inclination, a second part 17B bent back slightly relative to the first in the direction towards the main path, and a third part 17C and a fourth or end part 17D bent back slightly relative to each other and having respective inclinations similar to those of the first part and the second part.

As seen in FIG. 5 the end parts 17D and 17C are crenellated by virtue of a series of cut-outs 17D. Only these crenellated end parts 17D and 17C intersect the main path 10 when the deflector flap is in the document diversion position.

These bends enable the document to be diverted substantially at right angles from the main path to the secondary path with a short arcuate transition on the document obtained by the two parts 17C and 17D of the deflector flap intersecting the main path. They also allow movement of the deflector flap between its unoperated and diversion positions in a restricted space in front of the pair of ejector rollers and so contribute to the compact overall size of the folding machine.

The overturning module 2 shown in FIG. 1 associated with the folding module 1 proper comprises two pairs of belt 70 and 71 defining between them downstream of the roller 15A an arcuate path above the main path 10 for optional turning over of folded documents.

A pair of rollers 72A and 72B to either side of the main path 10 feeds either the overturning path or the output module 4. A deflector flap 73 is mounted below the main part 10 and downstream of the rollers 72A and 72B. It is moved by a control mechanism 74 between an unoperated position shown in dashed outline and a folded document overturning position shown in full outline. In its unoperated position it allows the folded document to pass freely along the main path 10 downstream of the rollers 72A and 72B. In its overturning position, however, it intersects the main path and forces the document leaving the rollers 72A and 72B into the overturning path.

The belts 70 and 71 are endless belts. The two belts 70 are the innermost belts in the folding machine; they are tensioned between the roller 72A, an input pulley 75 in the overturning module 4, an upper pulley 76 in substantial vertical alignment with the pulley 75 and other tensioning pulleys that are shown but do not carry reference numbers. The belts 71 are the outermost belts in the folding machine and face the belts 70; they are tensioned between a lower pulley 77 downstream of the roller 72A, an upper pulley 78 above the pulley 75 and tensioning pulleys that are shown but do not carry reference numbers.

The overturning deflector flap 73 extends across the width of the main path. In cross-section its profile has a linear part 73A by which the flap is supported and an arcuate part 73B bent back relative to the linear part on the side towards the rollers 72A and 72B and which constitutes the flap proper. The concave side of the arcuate part 73B faces towards the rollers 72A, 72B. The flap pivots on a fixed shaft 80 by means of two end lugs 73C on its linear part 73A.

Its control mechanism 74 is shown for each of its two positions, once in dashed outline and again in full outline, and comprises a control solenoid 81 the plunger of which is connected to a control lever 82 shown in thick dashed outline for the overturning position of the flap 73. This control lever pivots on a fixed shaft 82A to transmit commands that it receives to the flap 73 through a knuckle joint linkage comprising a lever 83 and an arm 84 coupling the overturning flap to the control lever 82.

The arm 84 is articulated to an intermediate point on the lugs 73C and to the end of the lever 83 which is in turn articulated to the control lever on the shaft 82A. Two abutment members 86 and 87 limit possible movement of the arm 84 to either side.

The solenoid 81 receives commands from the control circuit of the folding machine; the arrow 81A represents the command that it transmits to the lever 82 to move the flap 73 from its unoperated position to the overturning position. This mechanism operates in a similar way to the control mechanisms 26 and 27.

When the deflector flap 73 is in the overturning position its arcuate curved part 72B couples the main path to the overturning path. This arcuate part is withdrawn beneath the main path 10 when the overturning deflector flap 73 is in the unoperated position.

FIG. 7 shows in a schematic way the driving of the rollers 72A, 72B and of the belts 70 and 71 from the pulley 56. A selective coupling schematically represented by a line 79 and described with reference to FIG. 6 drives the roller 72B from the pulley 56 in one direction or the other. A gear coupling schematically represented by a line 88 drives the roller 72A and the belts 70 from the roller 72B; a chain coupling schematically represented by a line 89 drives the belts 71 from the roller 72B.

The drive system further comprises an encoder disk 50 (seen also in FIG. 3) mounted on the shaft of the roller 14B. The encoder disk 50 has 100 regularly spaced holes (not shown) in its periphery which are sensed by photo-electric cells 50A giving the successive angular positions of the disk and defining a main clock for the control circuit of the general-purpose folding machine that is synchronized with the drive system.

The overall arrangement of the folding and overturning modules is also described with reference to FIG. 7.

FIG. 7 shows that the folding module 1 and the overturning module 2 are both openable to provide free access to the main path or to the overturning path for clearing any jams that may occur there.

The folding module 1 has an upper part 1A and a lower part 1B. The upper part comprises the upper rollers 13A, 14A and 50B, the folding blades, their control mechanisms and the corresponding part of the drive system (not assigned any reference numbers). The lower part comprises the main path and the components situated under the main path, their control mechanisms and the corresponding part of the drive system. The upper part 1A is mounted to rotate about the shaft of the roller 13A to pivot from its normal position in which it is designated 1A to an opened position denoted 1A'. Its opening movement is shown by the arrow 1C. The lower part 1B is fixed as is the main path (not visible here).

The overturning module 2 has an upper part 2A and a lower part 2B separated by the main path which is part of the lower part. The lower part 2B is fixed with respect to the fixed part 1B of the module 1. The upper part 1A is partially openable as shown by the arrow 2C; it comprises a fixed part 2D including the belt 70 of the overturning path, which is the innermost belt in the folding machine, the pulleys 75 and 76 and the roller 72A on which it is mounted, and an opening part 2E including the other belt 71 of the overturning path and its pulleys. The opening part is denoted 2E' in its open position, which is obtained by pivoting about the axis of the pulley 77 the arm carrying the other pulleys relevant to the belt 71. As an alternative to this, the opening part could relate to the upper part of the belt 71 in which case it would be opened by pivoting about the shaft of the exterior pulley intermediate the lower pulley 77 and the upper pulley 78. This variant opens sufficiently to provide access to the overturning path, if needed.

The assembly of the various component parts, their control mechanisms and the drive system are explained with reference to FIGS. 3 through 6.

Figure 4:
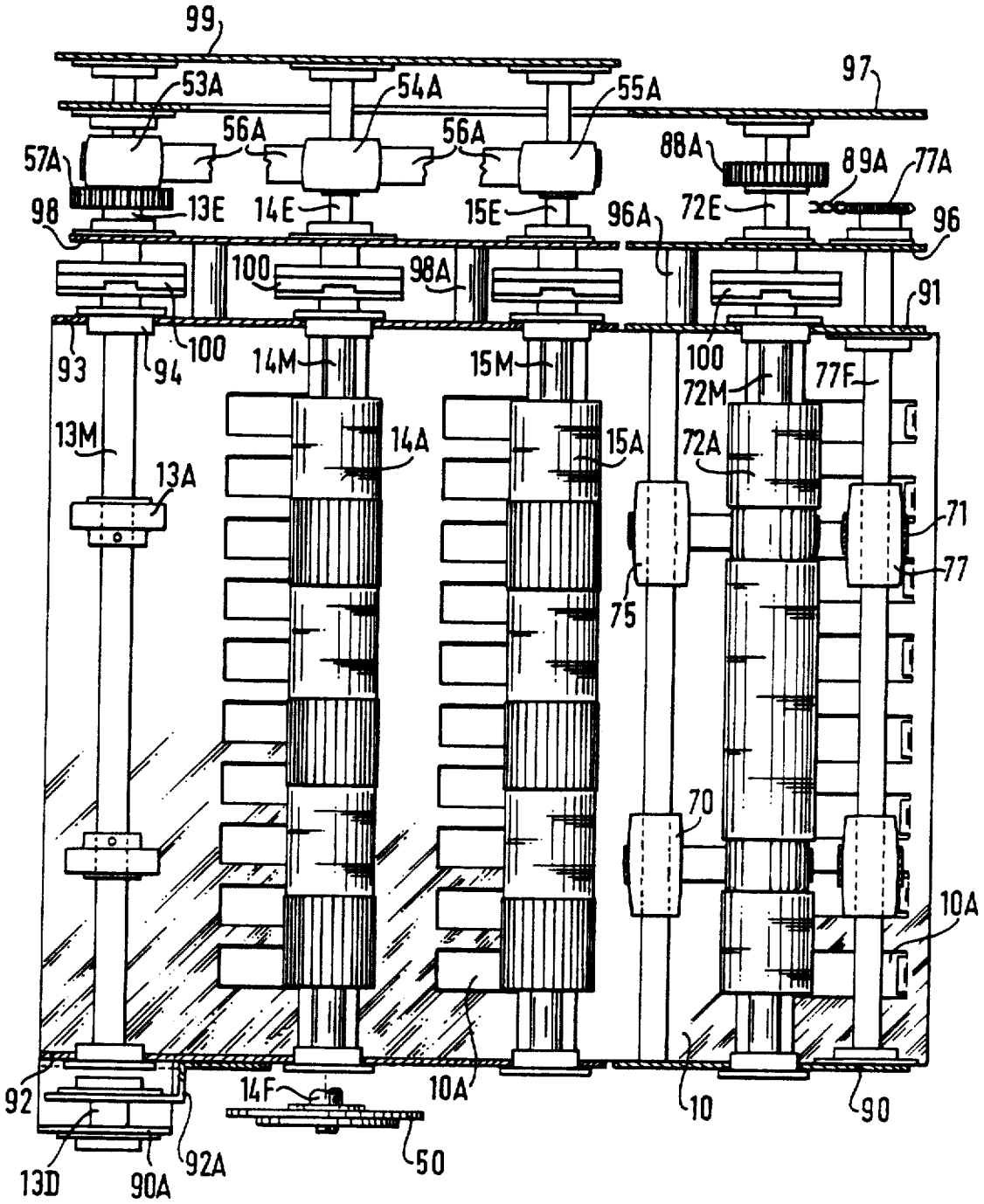
FIG. 4 is a view of the folding machine in longitudinal cross-section on the line IV—IV in FIG. 1.

With particular reference to FIGS. 3 and 4 in conjunction with FIGS. 1 and 7, note that the components which are part of the fixed parts of the modules 1 and 2 and their control mechanisms are disposed between two fixed flanges, a front flange 90 and an interior rear flange 91.

The flanges 90 and 91 are L-shaped with the shorter leg vertical, extending over the full height of the overturning module 2. The shafts of the various rollers of the fixed parts are supported between them on ball bearings (not referenced).

These shafts are fixed and designated by the reference number of the roller concerned with the letter F as a suffix, except for the shaft of the roller 72A designated 72M which is "mobile" and which together with its ball bearings has vertical play in the flanges 90, 91. The components of the pivoting upper part of the module 1 are mounted between two upper flanges, a front flange 92 like the flange 90 and an interior rear flange 93 like the flange 91, to which they correspond, fitting within their L-shaped profile. By means of ball bearings that are not identified by reference numbers they carry between them the shafts of the rollers 13A, 14A and 15A concerned together with the control shafts of the folding blades. The shafts of the latter rollers with their ball bearings are also mobile, having vertical play with respect to the flanges 92 and 93, and are respectively designated by the refernce numbers 13M, 14M and 15M. These mobile shafts are mounted in the same way at each end by means of a member forming a cage 94 containing the respective ball bearing spring-loaded by a spring 95 (FIGS. 1, 2 and 3). In each pair of rollers the upper roller is mobile and the lower roller is fixed and the arrangement just described makes it possible to press the rollers of each pair against one another while accepting between them different successive multiple documents, folded or otherwise, with widely varying overall thicknesses.

The main path 10 defined by a platform is supported by the fixed flanges 90 and 91. It features series of openings such as the opening 10A in which the end parts of the various deflector flaps concerned are inserted when the latter are actuated.

The rollers 14A, 14B and 15A and 15B mounted between the flanges 90 and 91 or 92 and 93 comprise alternately smooth and striated strips. The rollers 72A and 72B are smooth, however, and receive slightly set back relative to their periphery the belts 70. The rollers 13A and 13B at the entry to the module 1 are not rollers in the strict sense of the term, comprising in actual fact two pairs of wheels on the shafts 13M and 13F.

The drive system of the folding machine is mounted between the flange 91 or a small fixed flange 96 and an exterior fixed flange 97 in the case of the fixed part of the folding module and the overturning module. It is mounted between two other mobile flanges 98 and 99 similar to the flange 93 to which they are fastened at the rear by spacers 98A in the case of the mobile part of the folding module. The aforementioned small fixed flange 96 substantially corresponds to the small vertical leg of the L-shaped profile of the flange 91 to which it is fastened by spacers 96A; the fixed flange 97 is L-shaped with its smaller vertical leg truncated.

The flanges 96 and 97 on the one hand and 98 and 99 on the other hand carry between them fixed shafts denoted 13E, 14E, 15E and 72E for driving the rollers 13A, 14A, 15A and 72A which are on mobile shafts. These drive shafts and the mobile shafts 13M, 14M, 15M and 72M are coupled in pairs through a permanent coupling device 100 allowing some misalignment of the two coupled shafts. One example of a device of this kind is the "OLDHAM" coupling which consists of a pair of flanges whose opposed faces carry diametrical slots and between which a floating disk is supported through corresponding diametral tongues arranged at right angles.

The flange 91 or the flanges 91 and 97 carry the fixed shafts of rotating members such as the rollers 13B, 14B and 72B and the pulleys 75 and 77 in particular.

FIGS. 3 and/or 4 show the gears 57A and 57B of the folding machine drive system which are mounted on the shafts 13E and 13F and couple the rollers 13A and 13B. Also seen are the pulleys 53A, 54A, 55A on the shafts 13E, 14E and 15E which couple the rollers 13A, 14A and 15A by means of the belt 56A. A gear 88A forming part of the coupling schematically represented by the line 88 in FIG. 7 is carried by the shaft 72E for the roller 72A. A sprocket wheel 77A is carried by the fixed shaft 77F of the pulleys 77 and receives a chain 89A which is part of the coupling schematically represented by the line 89 in FIG. 7.

The part of the drive system comprising the pulleys such as the pulley 41 visible in FIG. 3 driven by the belt 43 driving the control shafts of the cams 33 is mounted between the mobile flanges 99 and 93 with the individual clutches such as clutch 40.

FIGS. 3 and 4 also show how the mobile rear flanges 93, 98 and 99 are mounted to pivot directly about the axis of the fixed drive shaft 13E for the roller 13A. A coupling finger 13D is mounted between a support flange 92A fastened to the front mobile flange 92 and a lug 90A fastened to the front fixed flange 90 and located opposite the support flange 92A. This finger 13D is aligned with the shaft 13E with which it defines the rotation axis for pivoting of the upper part of the folding module.

The upper part of the fixed flange 90 carries a keyboard 120. This keyboard enables the operator to define the required folding positions and the folding mode ("zig-zag" or "rolled") for the documents. Like the various sensor cells, it is connected to the control circuit of the folding machine for input of these positions into the control circuit.

FIG. 3 also shows the encoder disk 50 driven with the drive system of the folding machine. It is mounted at the end of the fixed shaft 14F of the roller 14B to the front of the front fixed flange 90 so that it is between this flange and the board 20 carrying the control circuit. The sensor cells 50A associated with this encoder disk are connected to the control circuit on the board 20.

As already explained (but not shown in the figures) the encoder disk has a particular number (100, for example) of equidistant small holes at the periphery the sensing of which indicates successive angular positions of the wheel and defines a main clock H. A large number of holes can of course be used, but it is advantageous to limit this number to a relatively low value to avoid an excessively high manufacturing cost.

The selective coupling between the pulley 56 and the roller 72B schematically represented by the line 79 in FIG. 7 is described with reference to FIG. 6. It is of the "switching" type implemented in the form of two disk clutches 101 and 102 one or other of which enables the roller 72B to be driven in one or other direction.

The shaft 56C of the pulley 56 driven by the belt 56B is carried by the fixed rear flanges 91 and 97 and the front fixed flange 90. It constitutes the control shaft for the roller 72B. It carries one of the clutches (101) which couples it to a first gear 103 and a second gear 104 which it drives directly. The shaft of the roller 72B carries in corresponding relationship a first gear 105 fastened to that shaft and the second clutch 102 which couples it to a second gear 106. The second gears 104 and 106 mesh with each other directly. The first gears 103 and 105 mesh through an intermediate gear 107. The disk of the clutch 101 has a detent 108 cooperating with a rotation stop member 109. In a similar way a detent 110 on the disk of the clutch 102 cooperates with a rotation stop member 111.

The clutches 101 and 102 are magnetic clutches. Both are controlled by the control circuit of the folding machine. When the clutch 101 is energized the coupling between the shaft 56C and the shaft 72F of the roller 72B is made through the three gears 103, 107 and 105 and the shaft of the roller 72B is then driven in the same direction as the shaft 56C. As only the clutch 102 is energized the shaft of the roller 72B is driven through the two gears 104 and 106 and rotates in the opposite direction to the shaft 56C.

The detents 108 and 101 with their rotation stop members 109 and 111 make it possible to immobilize the winding part of the clutches.

Figure 6:
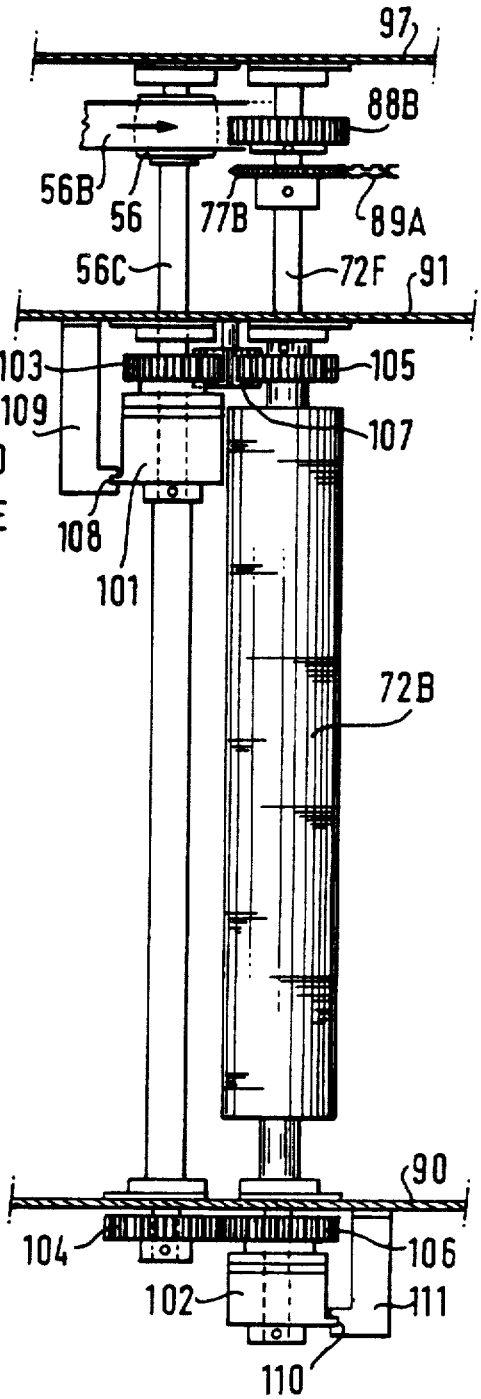
FIG. 6 is a view of the folding machine in longitudinal cross-section on the line VI—VI in FIG. 1.

FIG. 6 also shows on the shaft 72F of the roller 72B a gear 88B meshing with the gear 88A (FIG. 4) and defining with the latter the coupling between the rollers 72B and 72A. There is also shown a sprocket wheel 77B receiving the chain 89A (FIG. 4) and providing the coupling between the roller 72B and the drive pulleys 77 of the belts 71.

The control circuit of the general-purpose folding machine in accordance with the invention carried by the control board 20 (FIG. 3) is described hereinafter. It is not shown in the figures because it is essentially based on a control microprocessor connected to memories and counters with which is associated a processing unit. The memories are in turn connected to the input keyboard 120 shown in FIG. 3 to receive input data defining the required folding mode (zig-zag or rolled) for the documents to be processed. The counters are triggered by the photosensor 7 (FIG. 1) of the input module 3 and are incremented or decremented by a clock H synchronized to the forward movement of the documents and produced by means of the encoder disk 50 (FIG. 7).

The various commands of the folding machine are triggered by sensed states of the counters compared with stored reference values.

The organization of this control circuit emerges from FIGS. 8, 9 and 10 described hereinafter.

Figure 8:
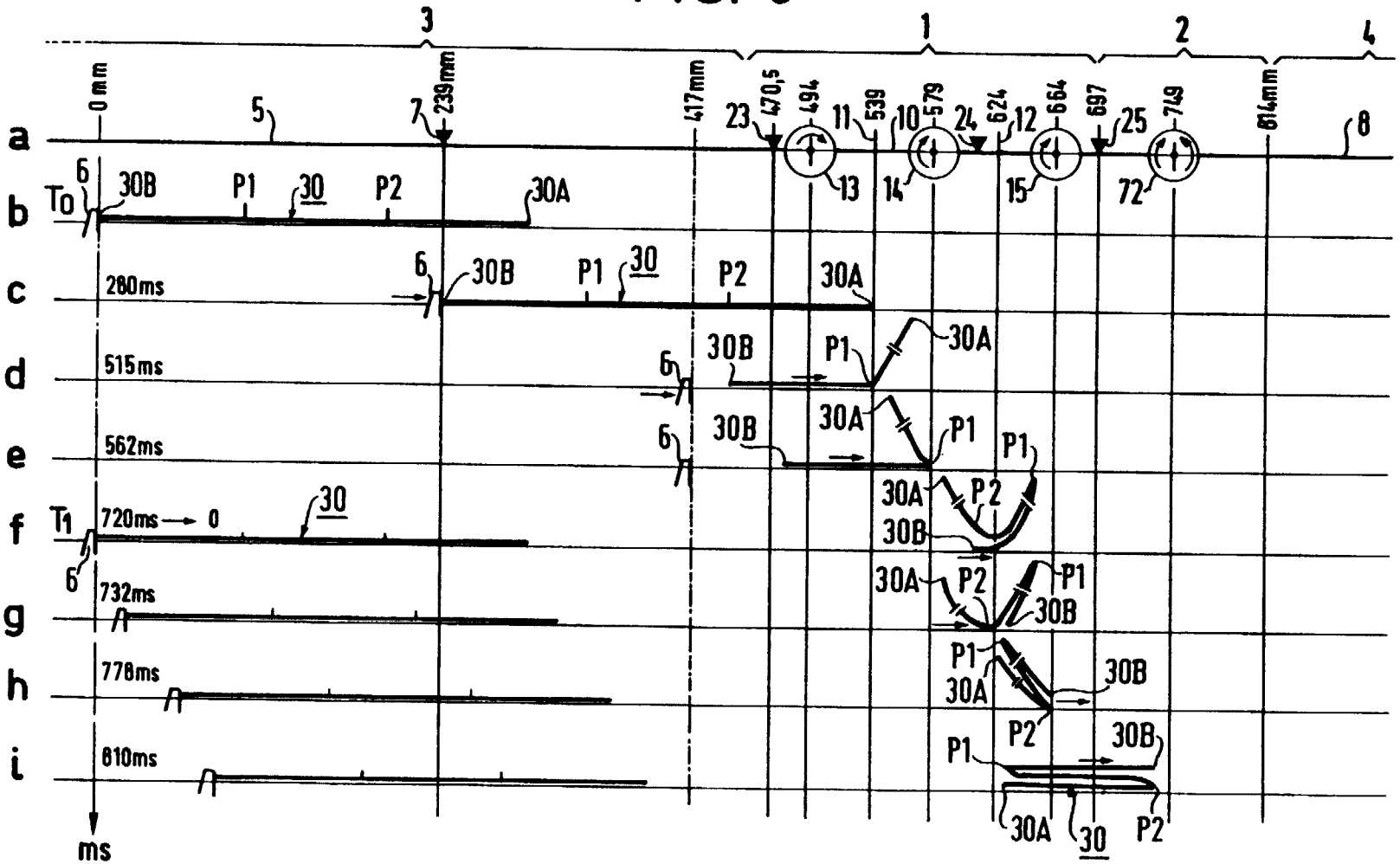
FIGS. 8 and 9 show the principal stages in operation of the folding machine for two different folding modes.
Figure 9:
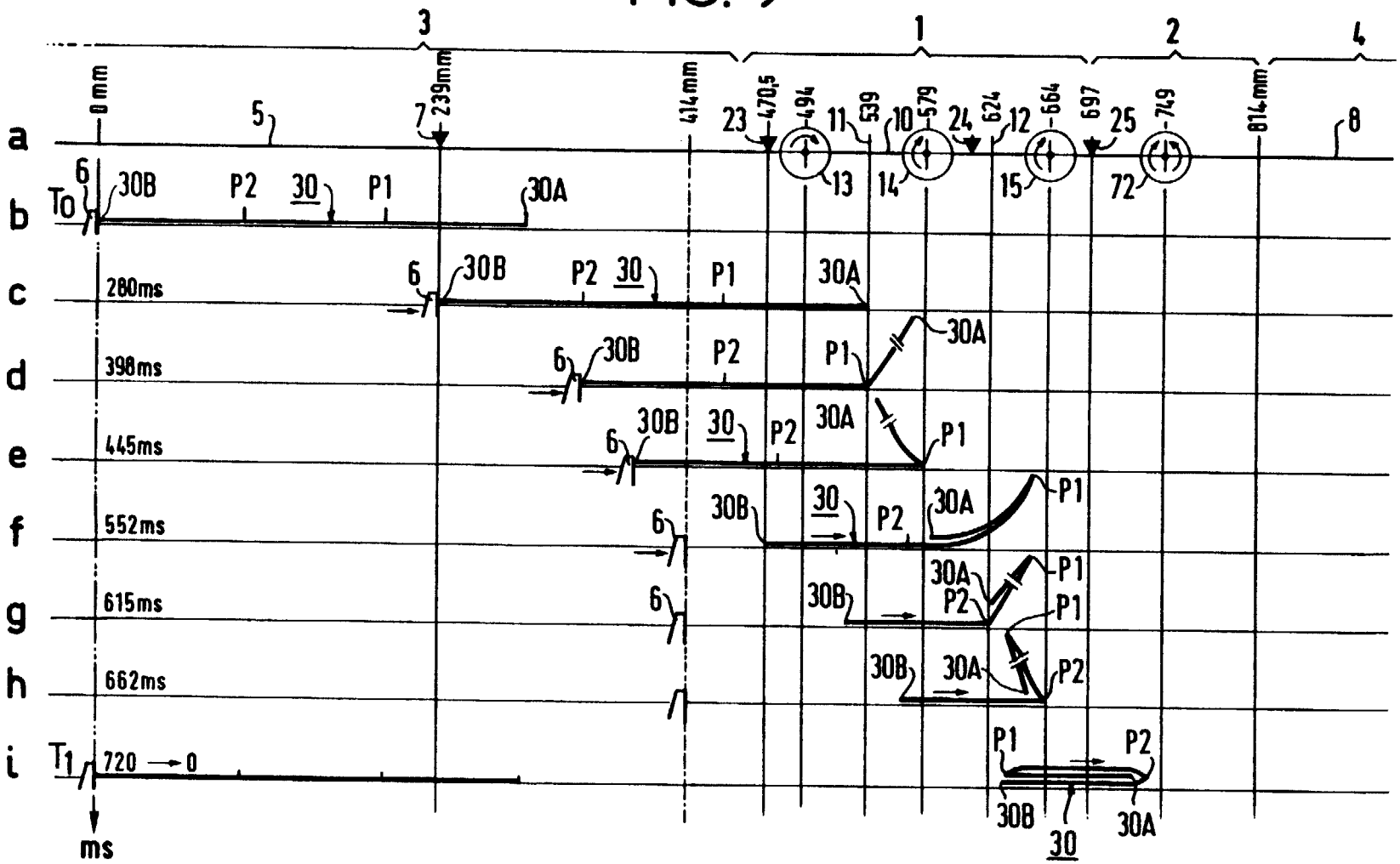

FIGS. 8 and 9 relate to FIG. 1 and illustrate the essential stages in the functioning of the general-purpose folding machine for a zig-zag document folding mode and a rolled folding mode.

In both figures the main path 10 of the folding module 1 and the overturning module 2 is shown at a. The path 5 of the input module 3 and the path 8 of the output module 4 are connected to this path a. On these paths are shown (substantially at their respective positions with dimensions in millimeters for one preferred embodiment) the four pairs of rollers denoted 13, 14, 15 and 72 on the path 10 and the photosensors 7, 23, 24 and 25 along both paths. The deflector and overturning flaps and the first and second folding blades have not been shown, however. The positions of the lower ends of the folding blades relative to the main path 10 have been shown, designated by the reference numbers 11 and 12 of the blades and denoted on the path 10 in their unoperated position.

At a the paths 5, 10 and 8 are shown free of any document and with the rollers already driven. This represents an initial stage from which the various stages of operation proper are described.

The stage represented at b shows a document 30 received on the path 5 of the input module 3. On this document P1 designates the position of the first fold required and P2 that of the second fold required, these having been previously defined and input via the keyboard into the memories of the control circuit of the folding machine. 30A designates the upper edge of the document and 30B the lower edge. The document 30 received is sensed by the photosensor 7 which authorizes it to be advanced by the lug 60 which until this time has been waiting to transfer a document; this is at the time denoted $T_0$ at which the folding cycle for this document begins; the subsequent stages of this cycle and successive cycles such as that T1 for the next document are defined relative to $T_0$ in milliseconds and for a throughput of 5 000 documents per hour.

Note from FIG. 8 and FIG. 9 that the positions of the first and second folds indicated on the document in stage b are reversed according to whether zig-zag or rolled folding is required.

The stage represented at c indicates sensing by the photosensor 7 of the lower edge 30B of the document pushed forward by the lug 6. This triggers the counters of the control circuit. In this stage c the upper edge of the document is already on the main path 10, the deflector flaps of which are in the diversion position.

The stage represented at d shows the position P1 of the first required fold opposite the lower end part of the first folding blade 11. Under these conditions the part of the document between the position P1 and its lower edge 30B is on the main path 10 and the other part of the document is diverted into the secondary path associated with the first blade. This stage d initiates commanding of the first folding blade whereas the first deflector flap associated with the latter is in the process of passing to its unoperated position.

Stage d in FIG. 8 shows also the document, almost all of which is in the folding module 1, when it is no longer being pushed forward by the lug 6 which has already stopped on the entry side of the module 1.

The stage represented at e shows the position P1 of the first fold when it has moved forward and is between the pair of ejector rollers 14 associated with the first folding blade. Under these conditions the lower end part of the first folding blade, which is operated with a rate of longitudinal advance substantially equal to that of the document along the path 10, has moved forward at the same time as the document. It is in its folding position from which it returns to the unoperated position without any time-delay.

The stage represented at f shows the first fold made by the first blade at the position P1 and the leading double-thickness edge of the document at P1 when it has moved beyond the rollers 14 (ejector rollers for the first folding blade and feed rollers for the second) and has already been diverted by the second deflector flap into the secondary path for the second folding blade. After the double-thickness document leading edge is intercepted at the first fold P1 the first deflector flap returns to the diversion position sooner or later depending on the length of document remaining on the path 10. In stage f the position P2 of the second fold advances simultaneously towards the end part of the second folding blade in the unoperated position, the second deflector flap associated with the second folding blade moving from its diversion position to its unoperated position.

Stage f in FIG. 9 shows the lug 6 when it is no longer driven and has stopped advancing the document.

The stage represented at g shows the position P2 of the second fold under the end part of the second folding blade 12 which is still in the unoperated position. This initiates the commanding of the second folding blade to its folding position and its advance with the document (and therefore with position P2 on the document) to this folding position.

The stage represented at h shows the position P2 of the second fold under the lower end part of the second blade which has arrived at the folding position. The blade inserts the document with the fold position P2 leading under the ejector rollers 15 and returns to its unoperated position. The part of the document already folded at position P1 and a double thickness of which is on the secondary path will fold substantially at P2.

The stage represented at i shows the ejection by the rollers 15 of the zig-zag folded document (FIG. 8) or rolled folded document (FIG. 9). During this stage i the second folding blade is in the unoperated position. However, as the return of its counter-blade 2 to the unoperated position is delayed, the latter is still in the folding position and holds the already double-thickness part in the secondary path of the second blade to prevent it opening out and to ensure that it is taken up with no unwanted creasing by the rollers 15.

At the end of stage i the folded document is delivered to the output module 4 either directly or after being turned over in the module 2 which is appropriately controlled by the circuit described with reference to FIG. 6.

The photosensors 23, 24 and 25 disposed along the main path are used essentially by the control circuit for ensuring that the folding machine functions in a secure way. In particular, they do not authorize actuation of the component immediately downstream of them until the presence of a document at their level is sensed; they inhibit this command and stop the folding machine if no document is sensed. The photosensor 25 and/or other photosensors in the overturning module and the output module (not shown) may be used to halt documents temporarily in order to adapt the rate of throughput of the folding machine to that of the machine on its downstream side, if necessary.

In FIGS. 8 and 9 the execution of the successive stages b through i by the control circuit is shown timed in milliseconds. In practise they are executed synchronously with the actual advance of the document in the modules 1 through 4 and is controlled by the main clock H synchronized to this actual advance provided by the aforementioned encoder disk 50 and the associated photosensor 50A (FIGS. 7 and 3) and a precision auxiliary clock h enabling the required folds to be executed with significantly greater precision than can be achieved with the main clock H alone.

Figure 10:
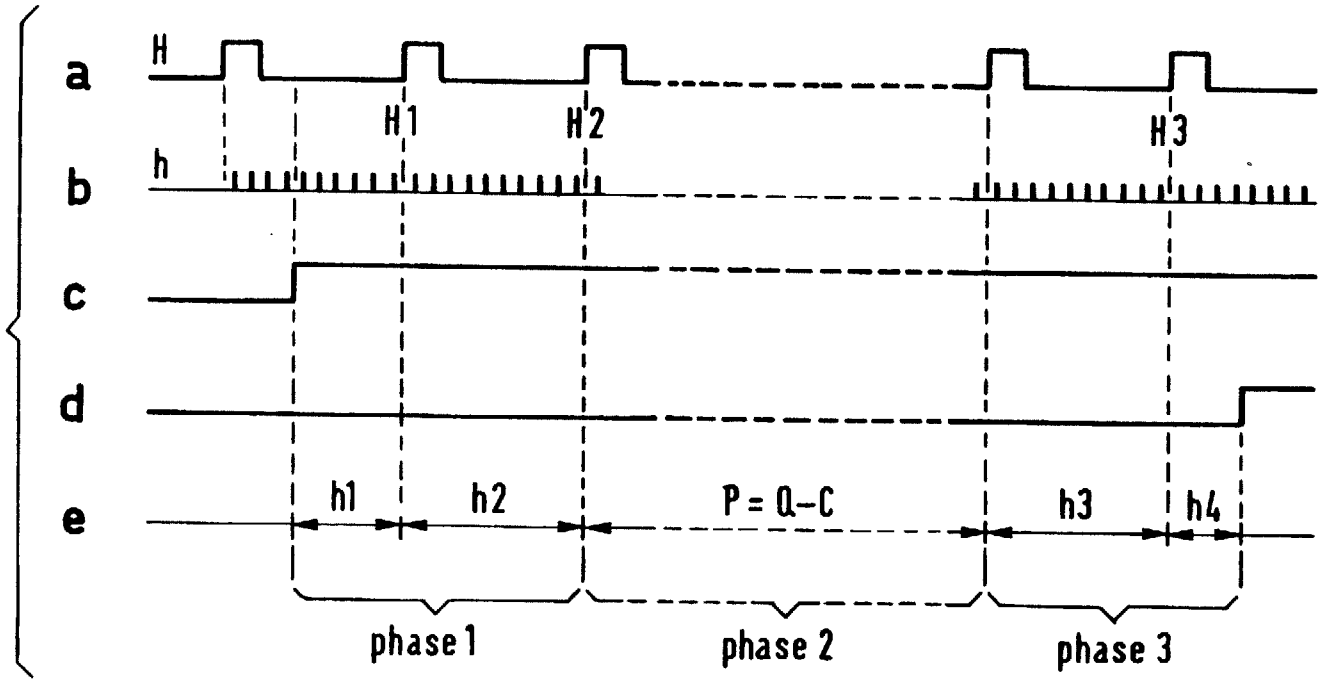
FIG. 10 is a diagram illustrating the functioning of a clock of a control circuit for a general-purpose folding machine in accordance with the invention.

The execution of the successive stages c through d for the first folding blade or c through for the second folding blade is controlled by the main clock H provided by the encoder disk 50 (FIGS. 7 and 3) and the associated precision auxiliary or quartz clock h as emerges from FIG. 10 relating to the control of one only of these folding blades.

FIG. 10 shows at a the clock signal H which comprises (for example) 100 pulses per revolution of the encoder disk 50, each pulse H corresponding to a constant or otherwise advance of the document (1.13 mm, for example). At b is shown the precision clock h. Its frequency is in the order of ten times higher than that of the signal H and the signal h is therefore represented by short lines. At there is shown the signal corresponding to sensing of the rear edge of the document by the photosensor 7 corresponding to stage c of FIGS. 8 and 9. At d is shown the control signal for one of the folding blades, the first folding blade for example, in stage d of FIGS. 8 and 9. At e is shown how the signal controlling the folding blade is derived from the clocks H and h in the control circuit of the folding machine to achieve highly accurate folding by the folding blade concerned, for example folding to within 1 mm of the required fold position. This control is exercised in three successive phases 1, 2 and 3 producing the folding blade control signal. These will now be explained:

phase 1: document sensing phase.

Phase 1 is triggered when the rear edge of the document is sensed by the photosensor 7 which resets the counters for the clocks H and h.

During phase 1 the number of clock h signals counted until the appearance of the first signal H1 from the clock H is denoted h1, followed by h2 signals from clock h between H1 and the second signal H2 from the clock H. The values h1 and h2 are memorized. The second value h2 corresponds to an advance increment p of the document. The second signal H2 from the clock H triggers phase 2.

phase 2: clock H signal downcounting phase.

This phase is executed by counting down at the rate of clock H the counter for clock H loaded for phase 2 with a specific value P. This value P is established from the integer number Q of advance increments p of the document for the known distance D between the photosensor 7 and the end of the folding blade to be operated. This number Q satisfies the equation: $D=Q.p+R$ in which R is the remainder of the division performed. The value of P is near the value Q and deduced from Q as follows: $P=Q-C$ where C is a constant taking the value 2 or 3 allowing for the complete increment executed in phase 1 and a complete increment projected for phase 3 and also the fraction h1/h2 of an increment executed in phase 1 and a fraction of an increment remaining to be determined and to be executed in phase 3. The sum of these fractional increments may or may not exceed a complete increment.

phase 3: folding blade command trigger phase.

Phase 3 is triggered when the counter for clock H loaded with the value P for phase 2 reaches zero.

It is executed by counting a number h3 of signals from the clock h until the appearance of the first clock signal H3 in phase 3 and then by counting from H3 a computed number h4 of signals from the clock h.

The number h4 and the value 2 or 3 of C are determined by the processing unit of the control circuit given that:

$$R/p=h1/h2+h4/h3$$

that is:

$$h4=(R/p-h1/h2)\ h3$$

If the value of $R/p-h1/h2$ is 0 or positive, then $C=2$ and:

$$h4=h3\ (R/p-h1/h2)$$

If the value of $R/p-h1/h2$ is negative then $C=3$ and:

$$h4=h3\ ((p+R)/p-h1/h2)$$

that is:

$$h4=h3\ (R/p+(1-h1/h2))$$

Detection of the number h4 of signals from the clock h triggers the command of the folding blade concerned. Controlling triggering of the command in this way makes it possible to achieve an accuracy of folding in the order of one millimeter.

The general-purpose folding machine in accordance with the invention described hereinabove has numerous advantages which, apart from the high degree of precision achieved, include:

its reliable operation, its compact dimensions (340×470×335 mm) with extremely compact folding and overturning modules, its great flexibility in use, with control from the keyboard of the folding mode, absence of folding and fold positions.

The general-purpose folding machine in accordance with the invention has the further advantage of accepting multiple documents irrespective of the number of sheets constituting the successive documents, their size and substance, it being possible to mix sheets with different formats and different substances to be folded together.

The general-purpose folding machine in accordance with the invention has been described with reference to the embodiment shown in the appended drawings. It is obvious that without departing from the scope of the present invention it is possible to make detailed modifications thereto and/or replace some means thereof with other, equivalent means.

What is claimed:

1. General purpose document folding machine for folding a flat document into three folds comprising:

a folding module coupled to an input module receiving documents to be folded on one side and to an output module supplying the folded documents to the opposite side, means defining a substantially horizontal main path through said modules, first and second folding blades, means for pivotably mounting said first and second folding blades, one after the other, above said main path in said folding module, first, second and third pairs of rollers along said main path in said folding module for advancing the documents, said first pair of rollers being mounted upstream of said first blade, said second pair of rollers being mounted between said first and second blades, and said third pair of rollers being mounted downstream of said second blade, first and second guide flaps, means for substantially vertically mounting said first and second guide flaps above said main path in said folding module, adjacent to said second and third pairs of rollers, respectively, on their upstream sides, first and second deflector flaps, means for pivotably mounting said first and second deflector flaps, underneath said main path in said folding module, and extending just upstream of said second and third pairs of rollers, respectively, for movement between a nondiversion position below said path and a diversion position within said path to selectively divert documents from said main path against said first and second guide flaps, respectively, when individually actuated to diversion position, detecting means for detecting the position of each document along the main path in said folding module and for controlling activation of each deflector flap to diversion position from nondiversion position and of each blade in folding position transversely to a diverted document, and folding blade drive means for driving each blade in folding position having a longitudinal speed component parallel to the main path substantially equal to the speed of the document moving along the main path.

2. Machine according to claim 1 wherein each blade extends transversely across and above said main path and has a golfclub-shaped profile in cross-section comprising a curved shorter leg near and substantially parallel to said main path with its concave side facing towards the downstream end of said main path and a substantially linear shank on which said shorter leg is supported.

3. General purpose document folding machine for folding a flat document into three folds comprising:

a folding module coupled to an input module receiving documents to be folded on one side and to an output module supplying the folded documents to the opposite side, means defining a substantially horizontal main path through said modules.

first and second folding blades, means for pivotably mounting said first and second folding blades, one after the other, above said main path in said folding module.

first, second and third pairs of rollers along said main path in said folding module for advancing the documents, said first pair of rollers being mounted between said first and second blades, and said third pair of rollers being mounted downstream of said second blade.

first and second guide flaps, means for substantially vertically mounting said first and second guide flaps above said main path in said folding module, adjacent to said second and third pairs of rollers, respectively, on their upstream sides, first and second deflector flaps, means for pivotably mounting said first and second deflector flaps, underneath said main path in said folding module, and extending just upstream of said second and third pairs of rollers, respectively, for movement between a nondiversion position below said path and a diversion position within said path to selectively divert documents from said main path against said first and second guide flaps, respectively, when individually actuated to diversion position, detecting means for detecting the position of each document along the main path in said folding module and for controlling activation of each deflector flap to diversion position from nondiversion position and of each blade in folding position transversely to a diverted document, folding blade drive means for driving each blade in folding position having a longitudinal speed component parallel to the main path substantially equal to the speed of the document moving along the main path, each blade extending transversely across and above said main path and having a golf-club-shaped profile in cross-section comprising a curved shorter leg near and substantially parallel to said main path with a concave side facing towards the downstream end of the main path and a substantially linear shank on which said shorter leg is supported, and wherein said drive means for each folding blade include a control shaft, an eccentric cam on said control shaft, a fixed shaft, a control lever pivoting on said fixed shaft, coupled to said cam and coupled to said folding blade, a drive mechanism common to all said folding blades and a selectively operable clutch coupling said control shaft to said drive mechanism.

4. Machine according to claim 3 wherein the profile in cross-section of each folding blade further includes at the opposite end to said curved shorter leg an end part bent relative to said shank in the opposite direction to said curved shorter leg and coupled to said control lever.

5. Machine according to claim 4 further comprising an idler roller at the end of said control lever and wherein said cam comprises a grooved disk defining a guide path for said idler roller.

6. Machine according to claim 4 wherein said control lever and said cam are duplicated, each control lever being coupled to a respective cam.

7. Machine according to claim 3 wherein each folding blade except said first blade is duplicated and comprises a folding blade proper and an associated counter-blade.

8. Machine according to claim 7 wherein each counter-blade has a profile substantially identical to that of the associated folding blade proper so as to be able to mate with the concave side thereof and includes a support lug whereby it is pivotably mounted on the shaft of the associated folding blade proper so as to move therewith as it is displaced from its unoperated position to its folding position.

9. Machine according to claim 8 further comprising a respective mechanism coupled to each counter-blade adapted to lock said counter-blade in the folding position and prevent it returning to the unoperated position in the absence of a command to release said counter-blade.

10. Machine according to claim 9 wherein said counter-blade locking mechanism comprises a ratchet wheel fastened to said counter-blade and free to rotate on the respective folding blade shaft, a notch in the edge of said ratchet wheel, a pawl inserted in said notch when said folding blade proper and said counter-blade are in said folding position to prevent said counter-blade returning to its unoperated position and a solenoid coupled to said pawl and selectively energized to unlock said ratchet wheel by retracting said pawl.

11. Machine according to claim 3 wherein each deflector flap operating mechanism comprises a solenoid, a control lever coupled to said solenoid and a knuckle joint linkage between said control lever and said flap defining respective limiting positions (unoperated and diversion) of said flap.

12. Machine according to claim 11 wherein each deflector flap comprises a lug at one end by means of which it is pivotally mounted on the shaft of the corresponding roller of the pair of feed rollers associated with the corresponding folding blade downstream of which it is disposed beneath the main path and at least the end portion of its opposite end is bent towards said main path.

13. Machine according to claim 12 wherein said portion of each deflector flap that is bent towards said main path comprises cut-outs forming a crenellated shape and said main path comprises openings in line with the crenellated portion of each deflector flap.

14. Machine according to claim 3 further comprising a module for turning over documents coupled to said pair of ejector rollers of said last folding blade and comprising a pair of feed rollers mounted on each side of said main path, an arcuate document overturning path above said main path downstream of said pair of feed rollers, document feed means on said arcuate path, an overturning flap and a control mechanism for said overturning flap which has an unoperated position and a diversion position whereby it selectively intersects said main path to couple said main path and said overturning path.

15. Machine according to claim 14 wherein said overturning flap control mechanism comprises a solenoid, a control lever coupled to said solenoid and a knuckle joint linkage between said control lever and said overturning flap downstream of said pair of feed rollers of said overturning module and adapted to pivot under said main path.

16. Machine according to claim 14 wherein the shafts of the rollers on one side of said path are mobile shafts movable relative to the fixed shafts of the rollers on the opposite side of said main path and further comprising spring-loading means opposing such relative movement.

17. Machine according to claim 16 further comprising fixed individual drive shafts, permanent coupling joints coupling said mobile shafts to said fixed individual drive shafts and a common drive mechanism whereby said fixed individual drive shafts are coupled to each other and to said fixed shafts.

18. Machine according to claim 17 further comprising a control device for selecting the direction in which said pair of feed rollers of said overturning module are rotated by said common drive mechanism, said control device comprising two clutches, an even number of gears whereby one of said clutches couples said fixed shaft of said pair of feed rollers of said overturning module to a drive shaft of said common drive mechanism and an odd number of gears whereby the other of said clutches couples said fixed shaft of said pair of feed rollers of said overturning module to a drive shaft of said common drive mechanism.

19. Machine according to claim 17 wherein said folding module comprises on either side of said main path a fixed lower part comprising said main path and one roller of each pair of rollers and an upper part adapted to pivot about a drive shaft of the other roller of the first pair of rollers on said main path and said overturning module comprises a pair of belts defining said arcuate overturning path and at least one of which is at least partially pivotable to open said overturning path.

20. Machine according to claim 17 further comprising a microprocessor-based control circuit implemented on a control circuit board connected to said individual clutches controlling said folding blades and to said individual solenoids controlling said deflector flaps and said overturning flap in order to control them, a keyboard connected to said control circuit for input of data defining the position of folds to be executed by the successive folding blades, a first photosensor, an encoder disk fastened to said common drive mechanism and coupled to said first photosensor to define a first clock synchronized to said common drive mechanism representing successive increments of displacement of documents along said main path and a second photosensor adapted to respond to passages of documents past a particular point on an entry path to said folding module by triggering the counting of a defined number P of pulses of said first clock substantially representative of the distance in displacement increments between said particular point and each of the said folding blades.

21. Machine according to claim 20 wherein said defined number P of pulses is at least one less than a maximum number of document advance increments from said particular point to each folding blade.

22. Machine according to claim 21 wherein said control circuit further comprises a second clock at a frequency higher than that of said first clock and triggered to count signals by said second photosensor and continuing to count at least until the first signal from said first clock is detected, whereby a first number h1 of signals from said second clock is detected, and is also triggered by the detection of said defined number P of signals from said first clock and continues to count until a second number h4 of signals from said second clock is detected, the sum of said numbers h and h4 representing to the nearest unit the fraction of document advance increments exceeding said maximum number and expressed by said second clock relative to said first clock.

23. Machine according to claim 22 wherein said control circuit also counts signals from said second clock between said first signal from said first clock and the next signal therefrom and between the $P^{th}$ signal from said first clock and the next signal therefrom to yield a third number h2 and a fourth number h3 of signals from said second clock, said fourth number being detected before said second number h4, counting of which is delayed by a signal from said first clock from said defined number P of signals, the sum $h1/h2+h3/h4$ representing to the nearest unit said fraction of document advance increments.

* * * * *